US006436015B1

(12) United States Patent
Frasco et al.

(10) Patent No.: US 6,436,015 B1
(45) **Date of Patent: *Aug. 20, 2002**

(54) WEIGHT PLATE HAVING A TRIAD OF INTEGRALLY FORMED HANDLES

(75) Inventors: Scott J. Frasco, Huntington Beach; Michael D. Rojas, Tustin, both of CA (US)

(73) Assignee: Iron Grip Barbell Company, Fountain Valley, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/022,207

(22) Filed: Feb. 11, 1998

(51) Int. Cl.[7] ..... A61B 21/072

(52) U.S. Cl. ..... 482/106; 482/93

(58) Field of Search ..... 482/93, 106–110, 482/50; D21/680–682

(56) References Cited

U.S. PATENT DOCUMENTS

| | | | | | |
|---|---|---|---|---|---|
| D215,057 | S | * | 8/1969 | Sun | 482/108 |
| 4,199,140 | A | | 4/1980 | Ferretti | |
| 4,369,968 | A | | 1/1983 | Price | |
| 4,618,142 | A | * | 10/1986 | Joseph | 482/106 |
| 4,673,173 | A | * | 6/1987 | Pengler | 482/93 |
| D299,373 | S | | 1/1989 | Parker | |
| 5,024,434 | A | * | 6/1991 | Smith | 482/106 |
| 5,137,502 | A | | 8/1992 | Anastasi | |
| D354,322 | S | * | 1/1995 | Vodhanel | D21/680 |
| D355,007 | S | | 1/1995 | Rojas et al. | |
| 5,853,355 | A | * | 12/1998 | Standish | 482/106 |

OTHER PUBLICATIONS

Photographs of Scientific Weightlifting Plate.
Counsilman, James, "Using Isometric Isontonic and Intermediary Exercises", Indiana Physical Fitness Program and Equipment, Indiana University Foundation.
Brochure for Roberts Weightlifting Plates.
Strength and Health Magazine of Apr. 1954 (labeled as Exhibit 118).
Strength and Health Magazine of Jan. 1948 (labeled as Exhibit 120).
Strength and Health Magazine of Nov. 1940 (labeled as Exhibit 121).
Strength and Health Magazine of May 1952 (labeled as Exhibit 122).
Strength and Health Magazine of Feb. 1955 (labeled as Exhibit 124).
Apollan Bell (undated) (labeled as Exhibit 124a).
Superman Magazine, Jan. 1939 (labeled as Exhibit 202).
Superman Magazine, Nov. 1938 (labeled as Exhibit 202a).
Iron Man Magazine of Jul. 1969 (labeled as Exhibit 203).
Iron Man Magazine of Nov. 1969 (labeled as Exhibit 204).
Iron Man Magazine of May 1970 (Exhibit 205).
Strength Athlete Magazine, Dec./ Jan. (undated) (labeled as Exhibit 267).

(List continued on next page.)

*Primary Examiner*—John Mulcahy
(74) *Attorney, Agent, or Firm*—Darby & Darby

(57) ABSTRACT

A weight plate for physical fitness is disclosed including a plate body formed with a central throughbore and having a plate periphery. The body is further formed with solely a single opening disposed radially outwardly from the central throughbore and at least midway out from the center of the body to the plate periphery. The sole opening has an outboard edge that cooperates with the plate periphery to define an integral handle element for grasping by a single hand to effect transport of the weight plate.

10 Claims, 2 Drawing Sheets

OTHER PUBLICATIONS

Strength Athlete Magazine Oct./Nov. 1988 (labeled as Exhibit 268).
Strength Athlete Magazine, Jun./Jul. (undated) (labeled as Exhibit 269).
Sporting Goods Magazine Excerpt. May/Jun. 1976 (labeled as Exhibit 297).
Photograph of York Plates with Two Elongated Indentations (undated) (labeled as Exhibit 297).

Leicester Mercury Article Entitled "Strongman developing a lighter touch", dated Jan. 23, 1990 (3 pages) (labeled as Exhibit 206).

* cited by examiner

WEIGHT PLATE HAVING A TRIAD OF INTEGRALLY FORMED HANDLES

FIELD OF THE INVENTION

The invention relates to body building equipment, and more particularly a more manufacturable weight plate having a unitary handle element to effect convenient and secure transport.

BACKGROUND OF THE INVENTION

Body building equipment often takes many forms to provide the resistance necessary to tear-down muscle tissue during an exercise regimen, Modernly, many ingenious resistance developing systems or machines have been developed, and utilizing, for example, pulleyed cables connected to stacks of weights, or stretchable band-like rubber components. These systems often promise faster and better results for exercisers. However, while the popularity of such fitness machines typically follows cyclic trends, free-weights remain the physical fitness apparatus of choice for many individuals.

Conventional free-weights are typically of the barbell variety. Generally, a barbell includes an elongated rigid bar for grasping with one or both hands and having removable weight plates at each end. The weight plates are typically included as a collection of plates for selective installation on the bar according to the user's ability. Traditional weight plates are generally disc-shaped, and formed with a central throughbore sized to slidably receive the end of the bar.

Although traditional weight plates, such as those described above, have succeeded in carrying out their intended purposes, there are many areas for substantial improvement. A key problem often associated with traditional weight plates involves the transport of individual plates from one location to the other. Because of the solid integral construction, traditional plates are difficult to grasp or control with a single hand. As a result, in order to safely move or install weight plates on a bar, both hands are often used to transport conventional plates.

One proposal for solving the aforementioned problem, disclosed in U.S. Pat. No. 5,137,502, and assigned to the assignees of the present invention, describes a disc member having an outer periphery and including a pair of generally diametrically opposed elongated openings parallel to one another and equidistant from a circular opening. The centers of the elongated openings are disposed at least midway out from the center of the disc member to the outer periphery of the disc member. The disc member is conveniently transportable with a single hand because of the elongated openings.

While the improved disc member described above works well for its intended purposes, the conventional wisdom at the time felt that having two diametrically opposed elongated openings would preserve the axial balancing of the plate. Unfortunately, the perceived necessity of forming a plurality of elongated openings creates a corresponding number of manufacturing finishing steps to place the product in a saleable state. These steps typically involve specialized de-burring operations and associated inspections to eliminate rough, sharp surfaces.

Therefore, the need exists for a more manufacturable weight plate having a construction that minimizes manufacturing costs and yet retains the capability of convenient trransport with a single hand. The weight plate of the present invention satisfies this need.

SUMMARY OF THE INVENTION

The weight plate of the present invention provides a convenient integrally formed sole handle element to enable transport of the plate with a single hand. Manufacturing costs to fabricate the weight plate are minimized due to the reduced number of openings required to form an operative plate.

To realize the advantages above, in one form, the invention comprises a weight plate including a plate body formed with a central throughbore and having a plate periphery. The body is further formed with solely a single opening disposed radially outwardly from the central throughbore and at least midway out from the center of the body to the plate periphery.

In another form, the invention comprises a weight plate including a plate body formed with a central throughbore and having a plate periphery. The body is further formed with a triad of spaced apart openings disposed equiangularly and positioned radially outwardly from the central throughbore and at least midway out from the center of the body to the plate periphery.

BRIEF DESCRIPTION OF THE DRAWINGS

Other features and advantages of the present invention will be apparent from the following detailed description when read in conjunction with the accompanying drawings, wherein.

DETAILED DESCRIPTION OF THE INVENTION

Figure 1:
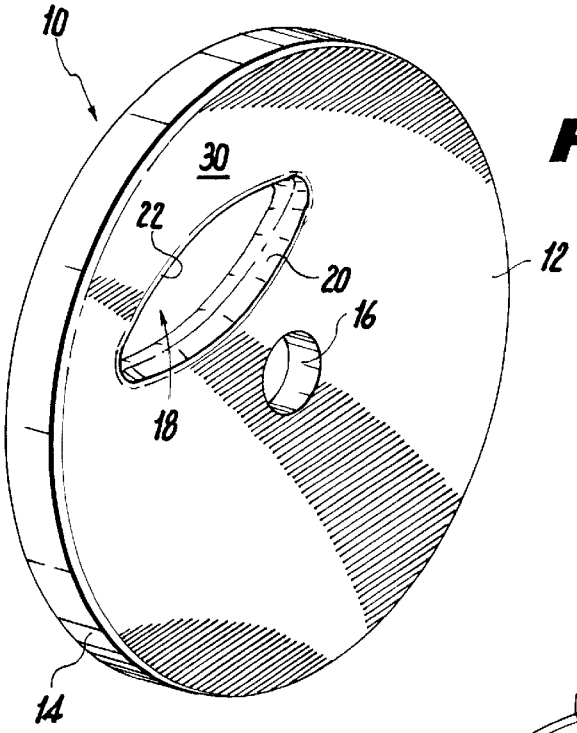
FIG. 1 is a perspective view of a weight plate according to one embodiment of the present invention.
Figure 2:
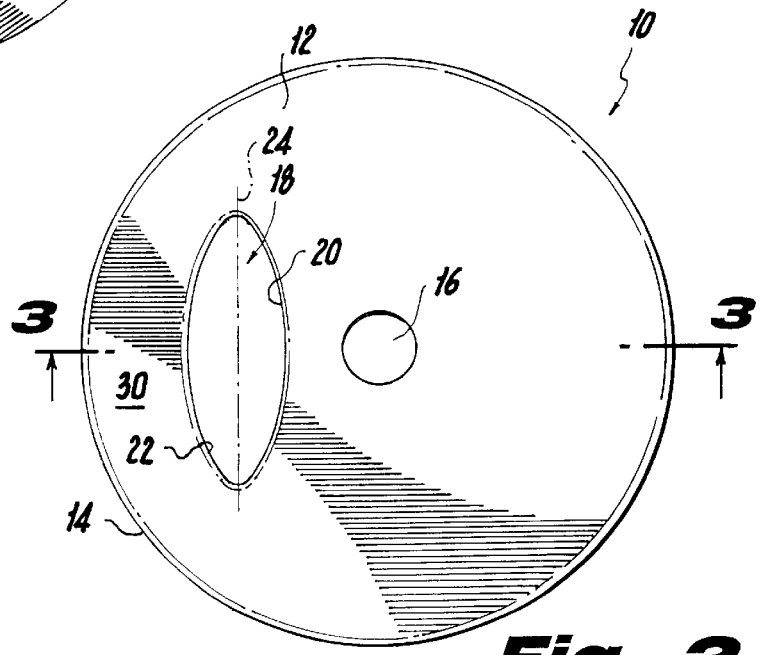
FIG. 2 is a plan view of the weight plate of FIG. 1.
Figure 3:
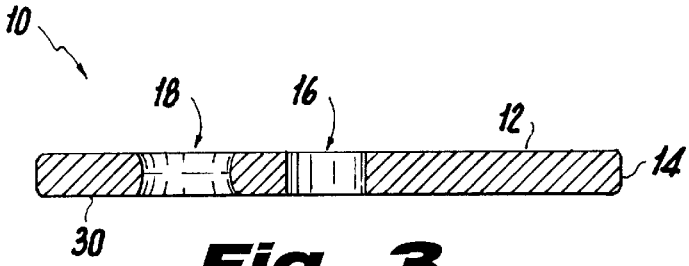
FIG. 3 is a cross-sectional view of the weight plate of FIG. 2 along lines 3–3.

Referring now to FIGS. 1–3, the weight plate of the present invention, generally designated 10, provides an integrally formed sole handle element 30 to effect transport of the weight plate from one location to another. By minimizing the number of openings formed in the weight plate, fabrication costs associated with finishing rough edges of the openings are substantially reduced, thereby also reducing the costs for consumers.

The plate 10 includes a plate body 12 having a substantially circular plate periphery 14 and formed from a rigid material, such as iron, steel, urethane, rubber, plastic, or a composite material. In order to provide a range of plates having varying weight, the dimensional characteristics of the plate often vary depending on the desired weight of the plate. As an example, a ten-pound weight may have a diameter of nine inches and a width of about one and one-half inch.

The plate is formed with a throughbore 16 extending axially through the center of the plate and sized to receive the end of a complementally formed bar (not shown). The opening is typically either one inch or two inches in diameter, depending upon the size of the corresponding bar.

Further referring to FIGS. 1–3, the body 12 is further formed with solely a single elongated opening 18 disposed radially outwardly from the central throughbore 16. The elongated opening is substantially oval-shaped with respective inboard and outboard edges 20 and 22 and having a longitudinal axis at 24 positioned at least midway out from the center of the body to the plate periphery 14. The oval opening is positioned in the body 12 so that the fingers of a human hand can pass through the opening and allow the thumb to wrap around the plate periphery of the body for sufficient gripping of the plate. The opening cooperates with the plate periphery and the material disposed therebetween to define the sole handle element 30 for enabling a single hand to grasp and transport the plate. The outboard edge 22 of the oval opening lies within about two inches from the plate radial periphery 14. Overall, the opening is approximately four and one-half inches in length with a width of about two inches to easily accept one or more fingers of a hand. Moreover, the inner periphery of the opening is slightly rounded to aid in gripping the weight.

Manufacture of the plate according to one embodiment of the present invention generally involves generating an iron casting of the plate, and when the casting is finished, deburring or finishing the respective peripheral edges of the opening 18, the throughbore 16, and the plate periphery 14 to create a smooth surface. Further steps often involved in manufacture of metallic plates include chroming the plate to achieve an appealing aesthetic finish, and coating the plate with a thermoplastic compound.

Alternatively, the weight plates may be formed by encasing a metal plate in a protective coating such as urethane, rubber, plastic or a composite material. Like the aforedescribed metal castings, the protective coatings often require finishing operations to render the edges of all openings smooth.

Although forming the sole opening 18 appears to render the plate axially unbalanced according to conventional wisdom, we have unexpectedly discovered that the effects of going against the conventional wisdom and unbalancing the plate with one elongated opening are negligible. Thus, it is readily apparent that by minimizing the number of openings on the plate, the number of manufacturing steps necessary to fabricate the plate may be reduced, and consequently the associated manufacturing costs.

In use, the weight plate 10 may be one of a collection of weight plates to provide variable weight capability for a barbell apparatus (not shown). The plates are often stored in a weight rack or organized on the floor for selective use by body building individuals. For particular free-weight exercises, a bar may be readied for installation of matching weight plates according to the present invention on each end. Once an exerciser determines the amount of weight to install on the bar, the corresponding plates are transported from the weight rack to the bar through the grasping by the hand around the sole handle element 30 formed into the plate. Additionally, because only one hand is used to transport the plate, the other hand may be utilized to steady the bar while the plates are installed thereon.

Figure 4:
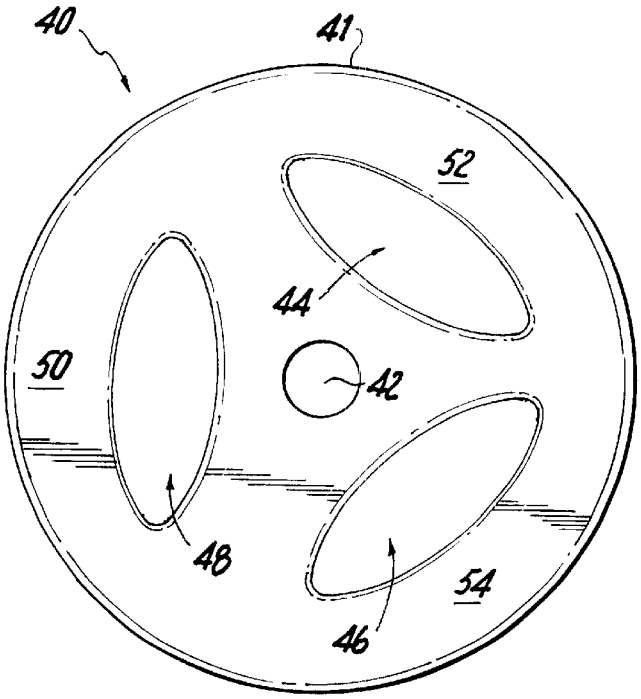
FIG. 4 is a perspective view of a weight plate according to a second embodiment of the present invention.

Referring now to FIG. 4, the present invention according to a second embodiment, generally designated 40, includes many of the features described above with respect to the first embodiment. The plate includes a body 41 formed with a central throughbore 42 and, unlike the plate of the first embodiment, includes an additional two elongated openings 44 and 46 spaced equiangularly from a first opening 48 to define a triad. The openings are generally oval-shaped, like the sole opening of the first embodiment, and positioned radially outwardly from the central throughbore and at least midway out from the center of the body to the periphery of the plate. The triad of openings cooperate with the periphery of the plate to define respective handle elements 50, 52 and 54. This construction allows a user to quickly find a handle element quickly and effortlessly.

Figure 5:
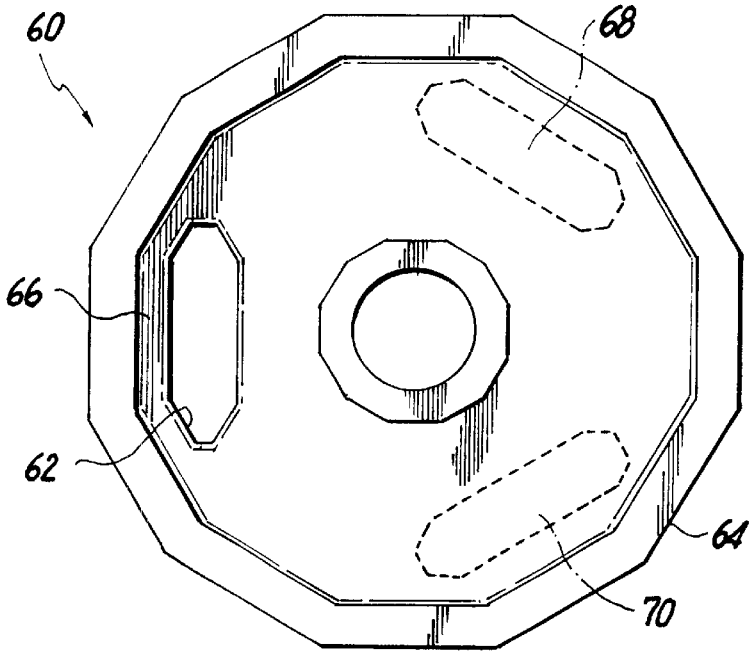
FIG. 5 is a plan view of a weight plate according to a third embodiment of the present invention.

FIG. 5 illustrates a further embodiment of the weight plate of the present invention. This embodiment, generally designated 60, like that of the first embodiment, incorporates solely a single opening 62 to cooperate with a substantially polygonal periphery 64 to define a sole handle element 66. However, it is envisioned that two more openings be formed (68 and 70 in phantom) to define a triad.

Those skilled in the art will appreciate the many benefits and advantages afforded the present invention. Of significant importance is the cost savings benefit during manufacture that the first embodiment allows while maintaining the advantage of providing an integrally formed handle element for single hand use.

While the invention has been particularly shown and described with reference to the preferred embodiments thereof, it will be understood by those skilled in the art that various changes in form and detail may be made therein without departing from the spirit and scope of the invention.

What is claimed is:

1. A weight plate for physical fitness including:

a plate body formed with a central throughbore and having a plate periphery;

said body further formed with solely a triad of spaced apart elongated handle openings disposed generally equiangularly and positioned radially outwardly from said central throughbore and at least midway out from the center of the body to said radial periphery, said openings having respective outboard edges cooperating with said plate to define a triad of integral handle elements for grasping by a single hand to effect transport of said weight plate.

2. A weight plate for physical fitness according to claim 1 wherein:

said body is formed of a metallic material.

3. A weight plate for physical fitness according to claim 1 wherein:

said body includes a protective coating thereon.

4. A weight plate for physical fitness according to claim 1 wherein:

said body includes a chrome plating thereon.

5. A weight plate for physical fitness according to claim 1 wherein:

said body comprises an extruded rigid plastic shell filled with sand.

6. A weight plate for physical fitness according to claim 1 wherein:

said respective openings are oval shaped and positioned on said body so that the fingers of a human hand can pass therethrough and allow a thumb to wrap around said plate periphery.

7. A weight plate for physical fitness according to claim 1 wherein:

said plate body is disc-shaped.

8. A weight plate for physical fitness according to claim 7 wherein:

said plate periphery is substantially circular.

9. A weight plate for physical fitness according to claim 7 wherein:

said plate periphery is substantially polygonal.

10. A weight apparatus including:

a plate body formed with a central throughbore and having a plate periphery;

said body further formed with solely a triad of spaced apart elongated handle openings disposed generally equiangularly and positioned radially outwardly from said central throughbore and at least midway out from the center of the body to said radial periphery, said openings having respective outboard edges cooperating with said plate to define a triad of integral handle elements for grasping by a single hand to effect transport of said weight plate:

a bar having respective ends wherein:

said central throughbore is complementally sized for slidable receipt on one of said bar ends.

* * * * *